US007070491B2

(12) United States Patent
Becksvoort

(10) Patent No.: US 7,070,491 B2
(45) Date of Patent: Jul. 4, 2006

(54) MACHINE TOOL WITH FLUID ACTUATED HELICAL ADJUSTMENT OF ABRASIVE ELEMENTS

(75) Inventor: Mark Lee Becksvoort, Hamilton, MI (US)

(73) Assignee: Bates Technologies, Inc., Fishers, IN (US)

( * ) Notice: Subject to any disclaimer, the term of this patent is extended or adjusted under 35 U.S.C. 154(b) by 46 days.

(21) Appl. No.: 10/825,402

(22) Filed: Apr. 15, 2004

(65) Prior Publication Data

US 2004/0253914 A1 Dec. 16, 2004

Related U.S. Application Data

(63) Continuation-in-part of application No. 10/193,767, filed on Jul. 10, 2002, now Pat. No. 6,739,949.

(51) Int. Cl.
*B24B 9/02* (2006.01)

(52) U.S. Cl. ..... 451/470; 451/472; 451/476; 451/478; 451/481; 451/484; 451/485

(58) Field of Classification Search ..... 451/28, 451/51, 52, 61, 470, 472, 476, 478, 481, 451/484, 485

See application file for complete search history.

(56) References Cited

U.S. PATENT DOCUMENTS

| | | | | |
|---|---|---|---|---|
| 2,213,027 | A | 8/1940 | Indge | |
| 2,309,485 | A | 1/1943 | Wallace | |
| 2,445,277 | A | 7/1948 | Mitchell | |
| 2,631,414 | A | 3/1953 | Muehling | |
| 2,741,071 | A | 4/1956 | Calvert | |
| 2,787,865 | A | 4/1957 | Gross | |
| 3,619,956 | A | 11/1971 | Gehring | |
| 3,707,810 | A | 1/1973 | Grosseau | |
| 4,075,794 | A | 2/1978 | Blaylock | |
| 4,655,007 | A | 4/1987 | Graft et al. | |
| 5,800,252 | A | 9/1998 | Hyatt | 451/61 |
| 5,957,766 | A | 9/1999 | Kalokhe et al. | 451/470 |
| 6,739,949 | B1 * | 5/2004 | Becksvoort et al. | 451/28 |

* cited by examiner

*Primary Examiner*—Timothy V. Eley
(74) *Attorney, Agent, or Firm*—Perman & Green, LLP

(57) ABSTRACT

The application describes a honing tool for use with a CNC machine. A fluid actuator provides the mechanism for causing radial adjustment of abrasive elements. The actuator consists of a piston and cylinder assembly mounted within the tool and powered by cooling fluid of the CNC machine. Actuation motion is driven by a helical drive on the piston which imparts rotary motion to a feed rod. Upper and lower feed rod sections are connected through a clutch. Axial movement is imparted to a feed cone by threaded engagement between the feed cone and the lower feed rod section.

8 Claims, 7 Drawing Sheets

MACHINE TOOL WITH FLUID ACTUATED HELICAL ADJUSTMENT OF ABRASIVE ELEMENTS

CROSS-REFERENCE TO RELATED APPLICATIONS

This application is a continuation in part application of U.S. application for patent Ser. No. 10/193,767, filed Jul. 10, 2002, now U.S. Pat. No. 6,737,949, issued May 25, 2004. Priority is claimed from this application with respect to common subject matter. The disclosure of this application is hereby incorporated herein by reference.

BACKGROUND OF THE INVENTION

1. Field of the Invention

Machines for boring and finishing cylindrical holes, such as engine cylinder bores, use a tool having abrasive strips mounted on a cylindrical body. As these tools wear, they are generally adjusted radially outward to compensate for the depletion of the abrasive surface. The wear compensating adjustment mechanism forms part of the tool body and comes in many shapes and sizes, for example the tool shown and described in U.S. Pat. No. 4,075,794. These tools consist of a mandrel which connects to the machine spindle at one end and is constructed with an abrasive head at the other. A connecting rod connects to an adjustment mechanism within the abrasive head to bias the abrasive elements radially outward against the work piece. The adjustment can be accomplished automatically as shown in the '794 patent or manually as shown in the reference Gross, U.S. Pat. No. 2,787,865.

The particular tools, shown in the above referenced patents, are used in honing machines for the construction of precision bores, such as piston cylinders in automotive engines, transmission pinion gears, and similar applications. In the past, such machines have been dedicated to specific tasks in association with particular production runs. With the onset of modern manufacturing concepts such as "Just in Time Manufacturing", lean manufacturing, and other inventory reduction methods, there is a need to apply flexible machining systems to the tasks that were previously performed by dedicated machinery. Flexible machine systems generally employ computer numerically controlled (CNC) equipment capable of performing multiple varied operations on multiple workpieces. It is a purpose of this invention to provide a honing tool for use with CNC machinery.

A common feature of CNC machines is the use of through the tool coolant dispersion for lubricating and cooling the abrasives during use. It is another purpose of this invention to utilize the cooling fluid of CNC machines to provide actuation of the abrasive stone adjustment.

One attempt to utilize coolant fluid to actuate the adjustment of abrasive elements is shown in U.S. Pat. No. 5,800,252. In this system a revamped tool is constructed which provides a supply of pressurized liquid down the length of the mandrel to the underside of the abrasive elements. This design requires a specially designed fluid supply and tool. It is a purpose of this invention to provide a honing tool for CNC machines that can be simply retrofitted to provide fluid actuation of the abrasive elements.

In certain systems, the honing tool is used in a single pass process. In such processes the abrasives are not collapsed, but remain at size and are expanded to compensate for wear.

The tools used in a single pass process generally utilize a different adjustment mechanism then is described above. The feed rod of such a mechanism is threaded and driven in rotation. Rotation in the threads moves the feed rod axially downward to expand the abrasive elements as needed. Such actuation is shown in the U.S. Pat. Nos. 4,075,794 and 2,787,865 cited above. It is a purpose of this invention to provide fluid actuation of a threaded adjustment mechanism.

SUMMARY OF THE INVENTION

A tool is constructed for a CNC machine station to perform a honing operation as part of a flexible machining system. The tool is an assembly of a tool body which holds the abrasive elements, a mandrel which supports the tool body, and a coupling which connects the tool to the CNC machine, as is well known. Commonly the abrasive elements are positioned in axially extending slots positioned circumferentially about the periphery of the tool body. The abrasive elements engage a wedge or cone shaped cam that is designed to convert an axial force into a radial force to move the abrasive elements radially. The radial force is generally exerted by the motion of a shaft extending axially through the mandrel to engage the cam surfaces.

In the system of this application, a closed pressure chamber is constructed at the spindle end of the mandrel. A piston is attached to the upper end of the adjustment shaft and mounted for movement within the chamber. The piston and axial shaft comprise the adjustment actuator assembly for the tool. The piston is spring biased towards the spindle end of the chamber. A supply of pressurized fluid or air is supplied to the chamber to force the piston to move along the axis of the mandrel against the force of the spring. The piston chamber is designed to accept the pressure of liquid or gas from a pump, or a regulator could be inserted into the supply channel to control the pressure. The fluid supply is preferably coolant fluid, and will be explained as coolant in this document. Such a fluid supply is generally available at the spindle of the CNC machine.

In accordance with this invention, a tool is constructed for use in a CNC machine station to perform a single pass honing operation as part of a flexible machining system. The auto-compensation system built into the tool of this invention is activated by the through spindle coolant system of the CNC machine when the tool needs to be expanded for abrasive wear. As the coolant is activated it will cause an internal piston of the tool to move downward. The piston is connected to the adjustment rod of the tool which moves with the piston. The piston is mounted in the tool body by means of a helical slot on its outside diameter. Downward motion of the piston in its helical mounting will cause the piston and adjustment rod assembly to rotate and cause the adjustment cone to move a metered amount downward. The adjustment cone is attached to the distal end of the adjustment rod in engagement with the cam surfaces of the abrasive elements. Movement of the cone downward expands the abrasive elements in a normal manner.

A clutch is constructed as a transmission member between upper and lower portions of the adjustment rod. The clutch allows the adjustment rod to rotate only in one direction, thereby, preventing the collapse of the abrasive elements on the return stroke of the piston. The coolant supply to the adjustment mechanism needs to be activated only for a short period to ensure the tool has expanded. The piston will then return to it's original position by the means of a spring.

BRIEF DESCRIPTION OF THE DRAWINGS

The invention will be described in more detail below with reference to the attached drawing in which.

DETAILED DESCRIPTION OF THE PREFERRED EMBODIMENT(S)

Figure 3:
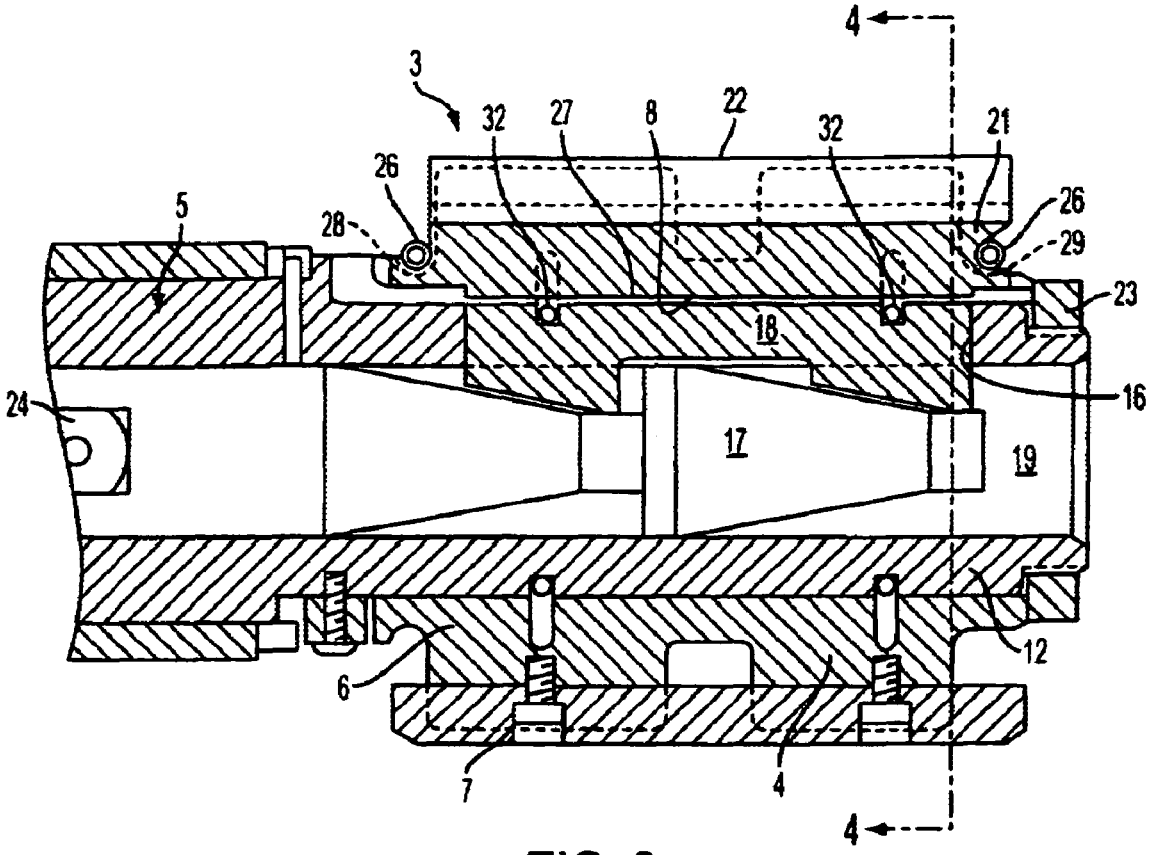
FIG. 3 PRIOR ART
FIG. 3 is a cut away view of a mandrel and tool body assembly showing an example of the internal parts of an expander mechanism.
Figure 4:
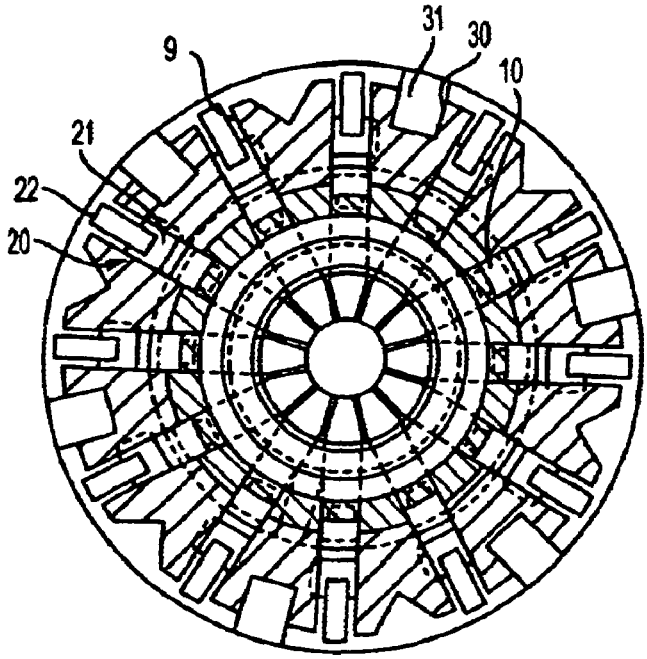
FIG. 4 is an end view of the mandrel and tool body assembly at section lines 4—4 of FIG. 3.
Figure 5:
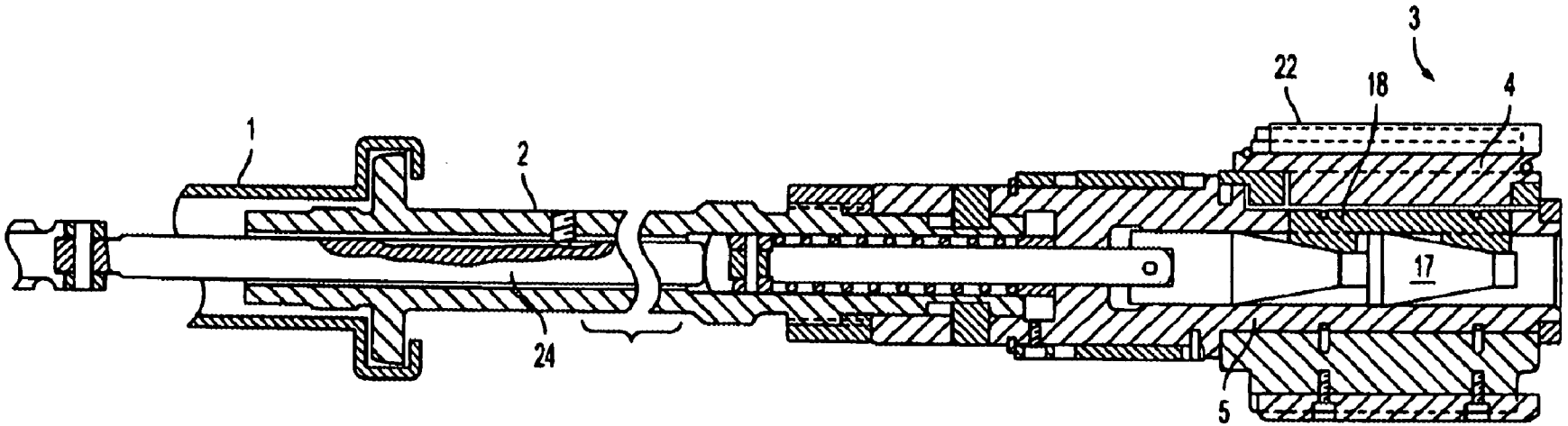
FIG. 5 PRIOR ART
FIG. 5 is a cut away view of the entire tool assembly from tip to spindle of the prior art.

A tool mechanism generally representative of the art is shown in FIGS. 3–5 and is constructed for installation on spindle 1 of a honing machine. Such a tool is described in U.S. Pat. No. 5,957,766, which issued on Sep. 28, 1999 to an assignee common to this application. The disclosure of the '766 patent is incorporated herein by reference. The tool of the '766 patent is shown as an example of an expansion adjustment mechanism. In this example, the tool body is removable from the mandrel, but this feature does not form part of this invention, as the adjustment actuator of the subject invention is adaptable to other tool configurations.

The illustrated tool consists of an elongated support shaft 2, which connects the machine spindle 1 to the tool. A mandrel 5 is a generally cylindrical element, attached to the distal end 3 of support shaft 2, which encloses an adjustment mechanism and other parts of the tool. Mandrel 5 is operatively connected to shaft 2 for rotation. A tool body 4 is mounted at the distal end 3 of the mandrel 5 and contains the abrasive elements 22.

As shown in FIGS. 3–5, tool body 4 is constructed as a shell having an outer periphery 7, an inner end 6, and an internal axial bore 8. Channels 9 are formed in the outer periphery 7 and extend axially to receive an abrasive assembly 20. The abrasive assembly 20 consists of a holder 21 and an abrasive block 22. The abrasive holder 21 is constructed with a bottom surface 27 for engagement with the expander element 18, described below. Holder 21 is held in place by elastic springs 26, as shown in FIG. 3. O-rings 26 engage projections 28 and 29 on either end of the holder 21. Additional channels 30 extend axially on the body 4 to receive guide members 31.

Elongated slots 10 are constructed at the base of the channel 9 which communicate with the internal bore 8 to provide access to the abrasive holder 21 from within. Inner end 6 contains a hexagonal recess to receive a mating drive surface on the mandrel 5 for transmission of drive torque from mandrel 5 to tool body 4. As previously stated the removable feature of the tool body 4 of the illustrated tool is not instrumental to this invention and tool body 4 could be fixed to the mandrel, as is well known in the art. Nevertheless the adjustment mechanisms are operationally similar and equally adaptable for use with the fluid adjustment apparatus of this invention.

The distal end 3 of mandrel 5, as shown in FIG. 3, has a cylindrical housing 12 sized to fit into the bore 8 of tool body 4. Housing 12 encloses the tip portion of the expander mechanism, identified by elements 17 and 18 shown in FIG. 3. The cam element 18 is held in place by elastic springs 32.

The housing 12, forms part of mandrel 5, and is constructed with an inner chamber 19 into which the expander mechanism extends. Housing 12 is constructed with slots 16 through which the expander element 18 extends for operative engagement with the bottom surface 27 of holder 21. This engagement is accomplished through the aligned slots 10 in tool body 4 and slots 16 in mandrel housing 12. The outer end of mandrel 5 has a threaded portion 25 to receive the threaded end cap 23, which serves to secure the tool body 4 on the mandrel 5.

As shown in FIG. 5, the expander cam (cone)17 is mounted at the tip end of an adjustment rod 24, which extends longitudinally within the support shaft 2 and connects with appropriate operating mechanisms within the spindle 1. The actuating rod 24, when actuated, pushes downward causing cam 17 to move radially outward. Cam 17 exerts a radial force on expander element 18, which is in contact with the surface 27 of holder 21. Axial movement of the adjustment rod 24 will, therefore, move the abrasive assembly 20 outward to compensate for wear.

The above description illustrates the general operation of an expansion mechanism used in many types of tools. In the prior art, adjustment rod 24 is mechanically connected to a control mechanism located in the machine spindle. In the mechanism of this invention, as shown in FIGS. 1–3, the adjustment rod 24 is connected through a fluid medium to its actuation control.

Figure 1:
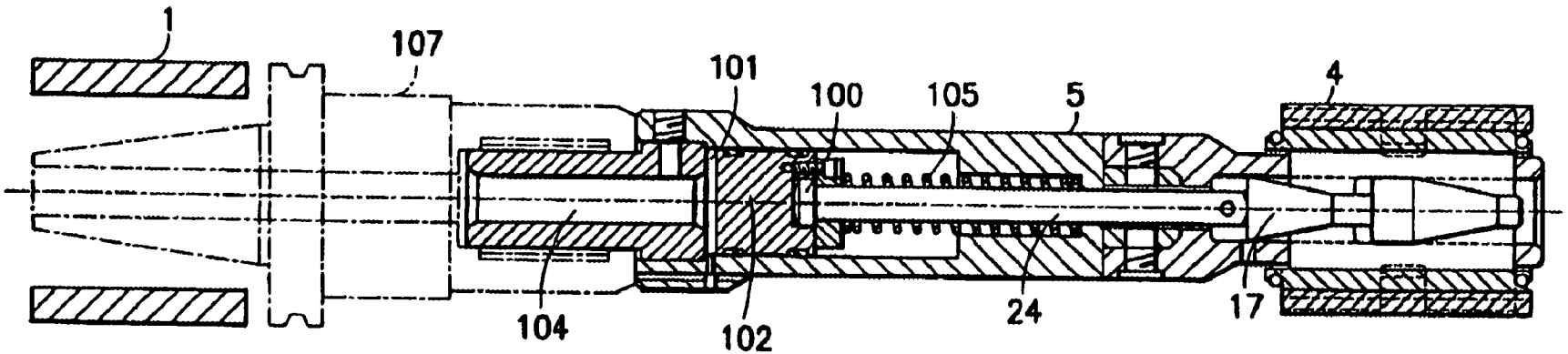
FIG. 1 is a side view of a tool with the housing of the mandrel cut away to show a fluid adjustment mechanism using a translatory adjustment motion.
Figure 2:
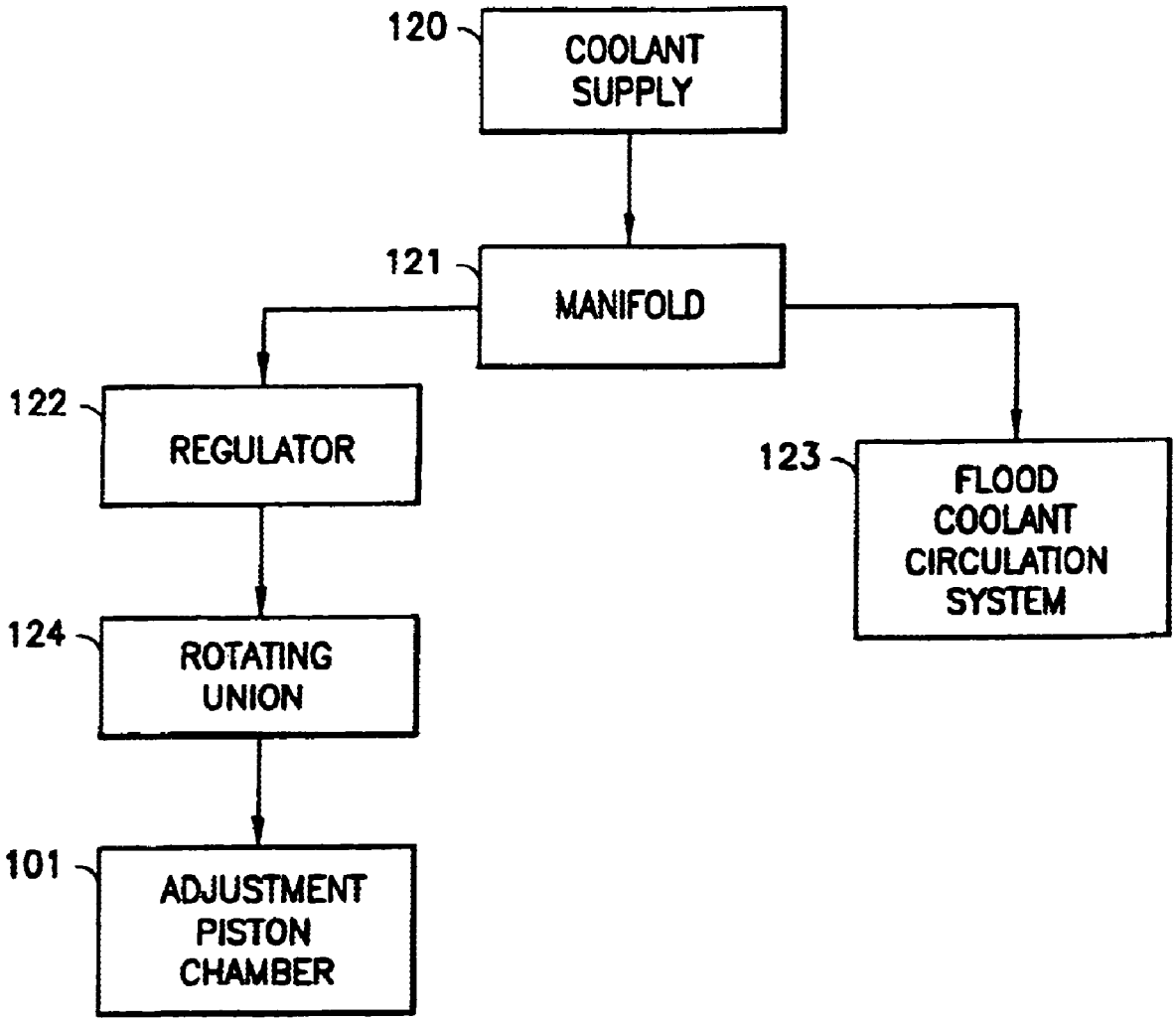
FIG. 2 is a block diagram of a fluid system for use with this invention.

As shown best in FIGS. 1 and 2, a honing tool is connected to the spindle of a CNC machine by means of a shank adapter 107. Adjustment rod 24 is mounted for axial movement within mandrel 5. A fluid chamber 102 is constructed at the spindle end of mandrel 5. The spindle end 100 of adjustment rod 24 extends into the fluid chamber 101 and is connected to a piston 102, which is coextensive in diameter to the chamber 101. Fluid pressure within chamber 101 acts on the upper surface of piston 102. The piston 102 includes sealing rings 103 to engage the inner walls of the chamber 101 in a sealing relation. Piston 102 is free to move within the chamber and such movement provides the adjustment motion for adjustment rod 24, as described above. A spring 105 is operatively connected to adjustment rod 24 to urge the rod 24 towards the spindle end of the mandrel 5.

A supply of coolant fluid is connected to the chamber 101 through channel 104, which is in turn connected through the spindle of the CNC machine. The pressure of coolant fluid exerts a down ward force on the piston 102 against the bias force of spring 105. This force is designed to exert a continuous force on the piston 102 of FIG. 1, which tends to expand the abrasive elements.

A typical coolant supply system used with CNC machines is shown in FIG. 2. The coolant supply reservoir 120 is connected through a manifold 121 to multiple delivery channels. Generally at least one of these channels supplies coolant to a flood coolant circulation system 123, which is designed to flood the workpiece with coolant, as an operation is being performed. Another channel directs fluid from the spindle through a rotating union 124, which allows the passage of fluid from a stationary part on the spindle to a rotating part on the tool. In this instance it is used to supply coolant fluid to the adjustment piston chamber 101. As there is less need in a honing operation to provide through the spindle coolant, this channel is available for other purposes and maybe used to supply the chamber 101. A honing operation generally relies on flood coolant to lubricate and cool the tool/workpiece interface. In order to adjust the pressure for use as an adjustment medium according to this invention, it may be advantageous to insert a pressure regulator 122 upstream of the rotating union for this application.

Figure 6B:
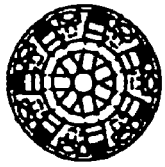
FIG. 6*b* is an end view of the tool of FIG. 6*a;*
Figure 6A:
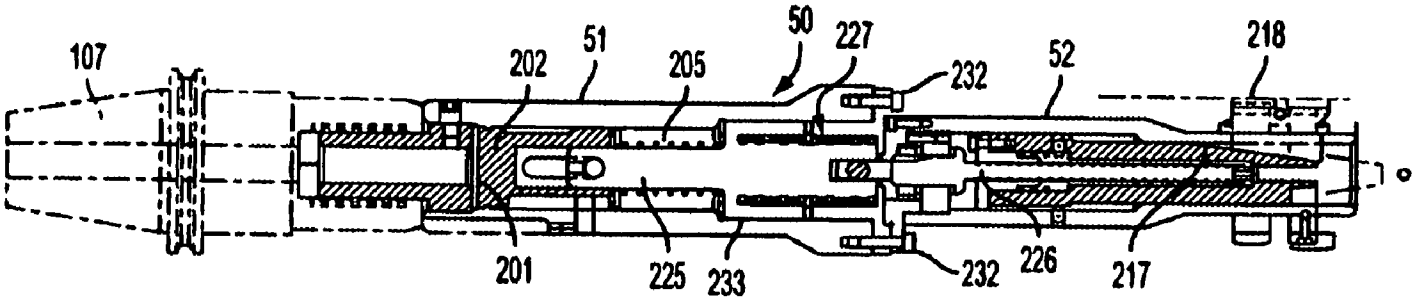
FIG. 6*a* is a side view of a tool with the housing of the mandrel cut away to show the fluid adjustment mechanism of this invention.

The tool of this invention is designed to provide fluid actuation to an abrasive adjustment system in which the downward motion of the adjustment rod is provided by a helical driving member. This is accomplished according to the embodiment shown in FIGS. 6–8. For the purpose of this description, it is assumed that the tool is oriented vertically with the abrasive (distal end) of the tool at the lower end. The motion of the parts of this adjustment mechanism will be generally up and down along the spindle axis.

Figure 7A:
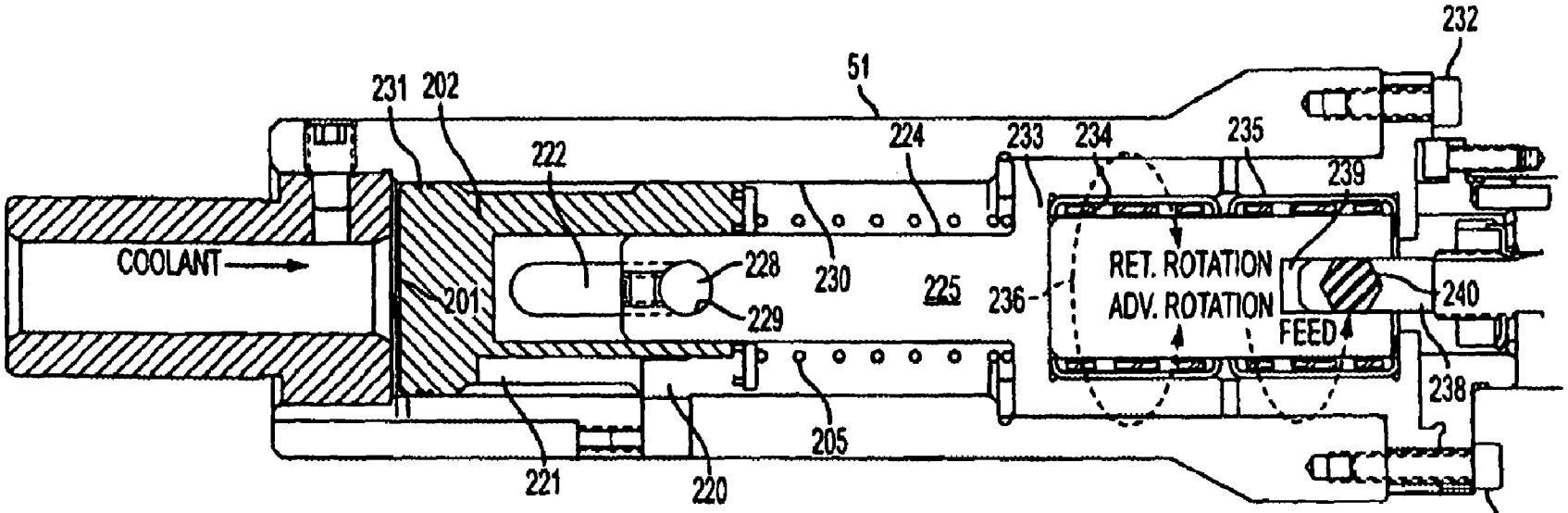
FIG. 7*a* is an enlarged view of the upper end of the tool shown in FIG. 6*a;*
Figure 7B:
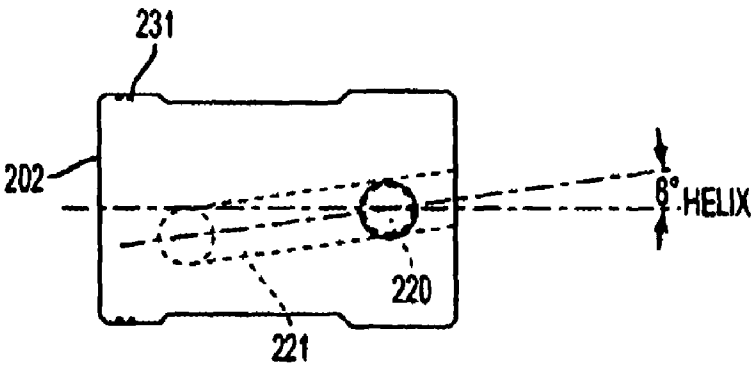
FIG. 7*b* is a view of the piston of the tool of FIG. 6*a*.

In the preferred embodiment, piston 202 is mounted within chamber 201 of mandrel 50 by means of a helical drive slot 221, as shown FIG. 7*b*. Drive pin 220 is held in mandrel 50 and extended into the helical drive slot 221. Drive pin 220 engages the piston 202 as a cam follower within the helical drive slot 221. Pin 220 causes the piston 202 to rotate as the piston is pushed downward by the force of the fluid. The fluid is supplied as described above.

The adjustment or feed rod 224 is constructed in two parts, an upper feed rod 225 and a lower feed rod 226 that are connected through a clutch mechanism 227. The upper portion 225 is connected to the piston 202 by a connecting pin 228 extending though a bore 229 in the upper end of the upper feed rod 224 (see FIG. 7). Connecting pin 228 extends through a slot 222 in piston 202. Slot 222 is elongated in the axial direction so that downward motion of the piston 202 is not transmitted to the upper feed rod 225. Rotational movement of the piston 202 is transmitted through the connecting pin 228. A coil spring 205 is mounted within the mandrel 50 to bias the piston in the upward direction.

Figure 8:
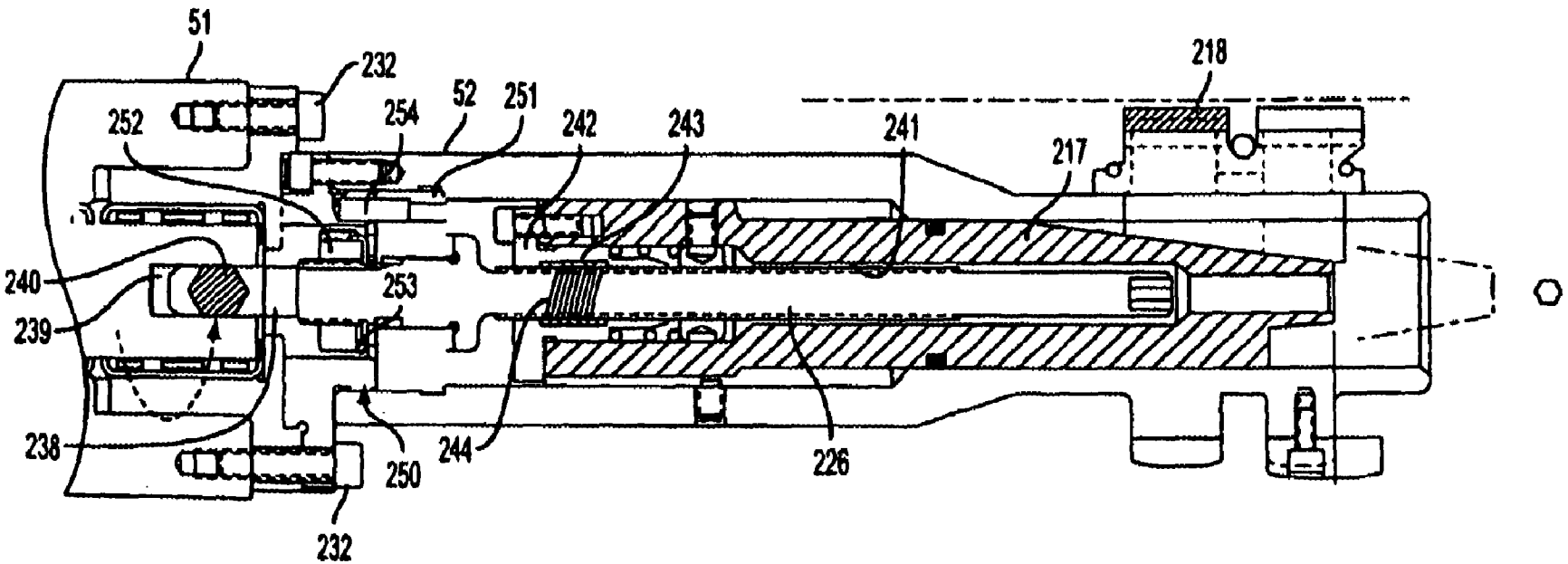
FIG. 8 is an enlarged view of the distal end of the tool shown in FIG. 6.

The chamber 201 is part of an extended axial bore 230 constructed in the mandrel 50. Piston rings 231 separate the fluid chamber 201 from the rest of the bore 230 and prevent fluid from passing by the piston 202. As shown in FIGS. 7 and 8, mandrel 50 is constructed having upper and lower sections 51 and 52 that are firmly connected by means of a series of bolts 232. Bore 230 is constructed to accommodate a clutch housing 233 formed in the lower end of upper feed rod 225. A pair of friction clutches 234 and 235 connect the upper and lower feed rods 225 and 226. Upper clutch 225 is mounted within clutch housing 233 and lower clutch 226 is mounted within a continuation of bore 230. The clutches cooperate to transmit rotary motion from upper feed rod 225 to lower feed rod 226 through transmission shaft 236.

Friction clutch 234 is mounted on the inner surface 237 of the clutch housing 233 and is designed to grab transmission shaft 236 and drive it in rotation during downward motion of piston 202. Friction clutch 235 is mounted on transmission shaft 236 and is designed to expand and engage inner surface of bore 230, when the piston 202 retracts, thereby preventing motion of the adjustment cone 217 that would tend to collapse the abrasive elements 218.

Bore 230 extends into the lower section 52 of mandrel 50 when the two sections 51 and 52 are connected. Lower feed rod 226 connects to transmission shaft 236 by means of lug 238 which mates with a slot 239 in shaft 236. A key 240 transmits rotary motion to the lower feed rod 226. The splitting of the mandrel 50 into sections 5.1 and 52 permits the disassembly of the clutch mechanism 237 for servicing.

Lower feed rod 226 extends downward into an axial bore 241 within adjustment cone 217. A bushing 242 is fixed to the cone member 217 to support lower feed rod 226. Bushing 242 is constructed with threads 243 which engage mating threads 244 constructed on lower feed rod 226. Through the threaded engagement, the rotary motion of the feed rod 225/226 is converted to an axial motion. The axial motion serves to expand the abrasive elements as is well known. Bearing assembly 250 at the top of lower feed rod 226 holds the feed shaft assembly in one position in order to force the cone element 217 down when the feed shaft is rotated. The bushing 251 is held in place by elements 51 & 52. A pin 254 keeps the bushing 251 from rotating. The bearing lock nut 252 and washer 253 are inserted to provide infinite adjustment for taking up the play in the feed shaft end chucking.

In operation piston 202 is forced downward by action of coolant in chamber 201. The interaction of drive pin 220 in helical slot 221 causes the feed rod 224 to rotate, while downward motion is absorbed by free movement of connection pin 228 in slot 222. As the upper feed rod 225 is rotated, it is connected to the transmission shaft 236 by clutch 227. Clutch 227 grabs the transmission shaft 236, causing it to rotate.

When the coolant pressure is released, the piston 202 will return to its upper position for the next adjustment cycle by the bias force provided by spring 205. It should be noticed that, because of the clutch mechanism 227, the retracting motion is not transmitted to the adjustment cone 217, thereby preventing collapse of the abrasive elements 218.

As the transmission shaft 236 rotates, it is connected to the lower feed rod 226 by the interaction of lug 238 and key 240 in slot 239. This connection allows transmission of the torque from upper feed rod 225 causing lower feed rod 226 to rotate. As lower feed rod 226 rotates, the feed cone 217 is forced in a forward motion by interaction of threads 243/244 causing the expansion of abrasive elements 218.

The clutch 227 is mounted in a manner that allows feed rod 224 to rotate in one direction only by preventing transmission shaft 236 from rotating backward. Upper feed rod 225 is allowed to rotate backward as piston 202 is returned, however, clutch 235 will grab the inside of tool bore 230 to prevent reverse rotation of transmission shaft 236, while clutch 234 slips on the outside diameter of the transmission shaft 236 allowing the upper feed rod 225 to rotate back and reset the piston in the helical slot 221.

During operation, the lower feed rod 226 is driven only in rotation, which drives adjustment cone 217 to travel downward on threaded bushing 242.

A spring 245 is mounted inside of the bore 241 to engage bushing 242 to compensate for any backlash in the cooperation of threads 243 and 244. Means are also provided to allow manual expansion of abrasive elements 218 at the lower end. This allows the cone to be adjusted manually, when it is off of the machine during initial set-up.

The invention claimed is:

1. An adjustment mechanism for a tool used on a machine, said machine having a drive spindle for connection to said tool, said tool having a plurality of abrasive elements mounted on the tool for radial movement with respect to the tool, said adjustment mechanism comprising:

an adjustment assembly mounted within said tool in engagement with said abrasive elements to convert an axial force to a radial force to actuate said radial movement of the abrasive elements;

a chamber formed in said tool;

a fluid connection for supplying fluid under pressure to said chamber;

a piston mounted for axial movement in said chamber, wherein said fluid acts on said piston to provide axial movement thereof, wherein said piston is mounted to rotate as it moves axially;

an adjustment rod mounted within said tool and connected to said piston in a manner which transmits only rotary motion to said adjustment rod in response to movement of said piston;

rotation limiting means mounted in said tool for engagement with the adjustment rod to allow rotation thereof in a single rotational direction, said rotational direction causing expansion of the abrasive elements; and wherein said adjustment rod is connected to the adjustment assembly by means which convert the rotation of the adjustment rod to an axial force to actuate radial movement of the abrasive elements.

2. An adjustment mechanism for a tool, according to claim 1, wherein said piston is rotated through the interaction of a drive mechanism connected between said chamber and said piston, said drive means imparting a rotary motion to said piston in response to axial movement of said piston.

3. An adjustment mechanism for a tool, according to claim 2, wherein said drive mechanism comprises:

a helical slot constructed in said piston; and a pin fixed to said chamber to engage said helical slot, said pin acting to force said piston to rotate during axial movement thereof.

4. An adjustment mechanism for a tool, according to claim 1, wherein said rotation limiting means comprises a clutch.

5. An adjustment mechanism for a tool, according to claim 4, wherein said adjustment rod comprises an upper adjustment rod and a lower adjustment rod, connected at an intermediate position by said clutch, said upper adjustment rod being connected to the piston and said lower adjustment rod connected to said adjustment assembly.

6. An adjustment mechanism for a tool, according to claim 5, wherein said clutch further comprises:

a transmission shaft;

a first friction clutch connected to said upper adjustment rod and adapted to engage said transmission shaft to cause rotation thereof upon rotation of said upper adjustment rod in said single rotational direction; and a second friction clutch connected to said transmission shaft to allow free rotation of said lower adjustment rod in said single rotational direction; and wherein, during reverse movement of said piston, said second friction clutch engages said tool to prevent rotation of said transmission shaft in a direction in reverse of said single rotational direction and said first friction clutch releases said transmission shaft to disconnect said shaft from said upper adjustment rod.

7. An adjustment mechanism for a tool, according to claim 1, wherein the adjustment rod is connected to said adjustment assembly by means of mutually engaging threads which convert the rotation of the adjustment rod to axial movement of said adjustment assembly.

8. An adjustment mechanism for a tool, according to claim 1, wherein said adjustment rod is connected to said piston by means of an axially extending opening constructed in said piston to receive said adjustment rod and a pin which extends transverse to an axis of the adjustment rod, through said upper end of the adjustment rod within said slot, wherein said piston is free to move axially on said adjustment rod, but is locked to said adjustment rod for transmitting rotary motion thereto.

* * * * *